US006036440A

United States Patent [19]

Tomita et al.

[11] Patent Number: 6,036,440

[45] Date of Patent: Mar. 14, 2000

[54] GAS TURBINE COOLED MOVING BLADE

[75] Inventors: Yasuoki Tomita; Hiroki Fukuno; Kiyoshi Suenaga, all of Takasago, Japan

[73] Assignee: Mitsubishi Heavy Industries, Ltd., Tokyo, Japan

[21] Appl. No.: 09/053,559

[22] Filed: Apr. 1, 1998

[30] Foreign Application Priority Data

Apr. 1, 1997 [JP] Japan ..... 9-082778

[51] Int. Cl.[7] ..... F01D 5/08; F01D 5/18

[52] U.S. Cl. ..... 416/96 R; 416/96 A; 416/97 R; 416/233; 415/114

[58] Field of Search ..... 416/96 R, 96 A, 416/97 R, 233; 415/114, 115

[56] References Cited

U.S. PATENT DOCUMENTS

| | | | |
|---|---|---|---|
| 3,628,885 | 12/1971 | Sidenstick et al. | 416/97 |
| 4,136,516 | 1/1979 | Corsmeier | 60/39.09 |
| 4,770,608 | 9/1988 | Anderson et al. | 416/97 R |
| 4,992,026 | 2/1991 | Ohtomo et al. | 416/97 R |
| 5,403,157 | 4/1995 | Moore | 416/96 R |
| 5,403,159 | 4/1995 | Green et al. | 416/97 R |
| 5,536,143 | 7/1996 | Jacala et al. | 416/96 R |

*Primary Examiner*—Edward K. Look
*Assistant Examiner*—Rhonda Barton
*Attorney, Agent, or Firm*—Alston & Bird LLP

[57] ABSTRACT

The present invention relates to a gas turbine cooled moving blade in order to cool the gas turbine using steam alone. In the moving blade, two cavities are installed in the lower part of the moving blade root section of the moving blade, a steam inlet is located in one cavity, and a steam outlet is installed in the other cavity. Steam is charged from the steam inlet and passes through a serpentine cooling passage consisting of a plurality of steam passages, and discharged to the steam outlet and collected. Bypasses are located near the base of the moving blade in the middle of each steam passage, so that cold steam on the leading edge side can be led into the bypass, mixed with the hot steam which comes from the tip section side and goes into the next downstream section of the steam passage, and flows to an upstream portion of the steam passage, thereby equalizing the steam temperature and cooling the steam over the entire range from the upstream to downstream of the steam flow. A turbulator is installed in the middle of steam passage in order to generate turbulence and enhance heat transfer. Since the moving blade is evenly cooled by steam alone without using air, and the steam is then collected, the performance of the gas turbine can be enhanced.

2 Claims, 5 Drawing Sheets

GAS TURBINE COOLED MOVING BLADE

FIELD OF THE INVENTION AND RELATED ART STATEMENT

The present invention relates to a gas turbine cooled moving blade.

Presently, a gas turbine moving blade is designed to be cooled by air, and a large volume of cooling air is consumed. For this reason, a large volume of cooling air is fed into the gas turbine moving blades resulting in unavoidable leakage of much cooling air and certain degradation of gas turbine performance. The following will describe an exemplary air cooling gas turbine system of the conventional art.

FIG. 3 is an internal view of an exemplary air cooling gas turbine moving blade, and FIG. 4 is a cross-sectional view taken substantially along line B—B of FIG. 3. In these drawings, reference numeral 11 indicates a general view of the moving blade, and reference numeral 12 the root section of the moving blade. Inside the moving blade, are installed air passages 13A, 13B, 13C, 13D, and 13E, of which air passages 13A and 13E form respectively an independent channel. Further, air passages 13C and 13D are in communication with each other in the upper section of the moving blade, while air passages 13D and 13B are in communication with each other in the lower section thereof, so as to form a serpentine cooling channel. There are turbulators 14 installed obliquely on the inner wall of each air passage 13A through 13E, so as to generate a turbulence of the air flowing in the moving blade in order to improve heat transfer.

In moving blade 11 having the above mentioned configuration, the cooling air 15-1 is led in through from a part of the turbine rotor cooling system not shown in the drawings and goes into the air passage 13A from the lower section of the root section 12 of the moving blade, Jetting out from the blowholes on the trailing edge fin as the cooling air 15-1 flows upward, thereby carrying out slot cooling 17 as also shown in FIG. 4.

Likewise cooling air 15-2 goes into the air passage 13C from the lower part of the moving blade root section 12, goes into the air passage 13D from the upper part of the air passage 13C, and then goes into the air passage 13B from the lower section of the air passage 13D. The cooling air takes heat away from each channel so as to internally cool the moving blade, then flows upward, and finally flows outside from the moving blade. Further, in the process of the air flowing through these air passages 13C, 13D, and 13B, the air, as FIG. 4 shows, is discharged from the slanting blowholes installed on the sides of the moving blade, to carry out film cooling 18.

Furthermore, similarly, cooling air 15-3 also goes into the air passage 13E from the lower section of the moving blade root section 12, then jets out from the blowholes located on the leading edge as the cooling air flows upward, to carry out shower head cooling 16. Thus, in order to cool the moving blade 11, a large volume of air flows into the moving blade 11, and the air is discharged after cooling the moving blade into the combustion gas passage outside the moving blade.

FIG. 5 is another exemplary air cooled moving blade system, in which FIG. 5(*a*) shows a longitudinal cross-sectional view of the air cooled moving blade system, and FIG. 5(*b*) shows a cross-sectional view taken along line C—C of FIG. 5(*a*). In these figures, reference numeral 21 indicates the moving blade, reference numeral 22 the moving blade root section, reference numeral 23 the internal cavity of the moving blade root section 22, and reference numeral 24 a rib inside the cavity 23. Reference numeral 25 indicates a number of multiholes drilled through longitudinally in a moving blade from the cavity 23 to the shroud 27 at the tip of the moving blade so as to be arranged along the central part of the moving blade as shown in FIG. 5(*b*).

In the moving blade 21 having such a structure as described above, cooling air 26 fed from the lower section of the moving blade root section 22 flows into the cavity 23 similar to the one in the example shown in FIG. 3, passes through the multiholes 25, while cooling the entire moving blade. After cooling the moving blade, the cooling air 26 is discharged out from the moving blade end or the shroud 27. In this example, similar to the above description, a large volume of air is also consumed and discharged to the external combustion gas passage.

As described above, in the gas turbine moving blade of the conventional art, a large volume of cooling air always flows through the moving blade to cool the moving blade, so that considerable power is spent on the compressor and cooler in order to produce high pressure air. This degrades the overall performance of the gas turbine.

Moreover, recently the concept of a hybrid cycle turbine system has been realized for enhancing power generation efficiency by combining the gas and steam turbines. In this hybrid system, in place of cooling air, the steam generated by the steam turbine is partly extracted and fed in to the moving blades of the gas turbine for cooling. This steam cooling system for gas turbine moving blade has not yet been put into practice to date.

OBJECT AND SUMMARY OF THE INVENTION

Accordingly, the object of the present invention is to provide the gas turbine cooled moving blade for enhancing the performance of the gas turbine by adopting a steam cooling system in place of a conventional air cooling system. This results in having a cooling structure suitable for steam cooling, permitting even steam cooling of the moving blade from the leading edge section to the trailing edge section, and effectively collecting and utilizing the steam after cooling.

To this end, the present invention further provides the following means for resolving the aforementioned problems.

In steam-cooled moving blade for gas turbines, steam is led from one end of the moving blade root section and conducted through the serpentine cooling passages arranged inside the moving blade from the base to the tip of the blade, so that steam is recovered. The steam is then discharged after cooling the gas turbine moving blade from the other end of said moving blade root section, and is then recovered. In at least one of partition walls installed between adjacent cooling passages a steam bypass is disposed.

The gas turbine cooled moving blade according to the present invention uses steam in place of conventional air. The steam is extracted partly from the steam generated by a steam turbine, supplied to the gas turbine moving blade, collected after cooling the moving blade, and returned to the steam supply side of the steam turbine for reuse. The steam flows from one end of the moving blade root section to the serpentine cooling channels of the moving blade, and after cooling the moving blade the steam is discharged to the other end of the moving blade root section so that the steam can be collected.

Since bypasses for steam are provided near or at the base of partition walls installed between adjacent portions of the cooling passage, when a part of the cold steam which is fed immediately before the bypass is fed into the next downstream cooling passage, the cold steam which has been partly bypassed into the next cooling passage is mixed with the hot steam having heated while running through the passage from the tip portion of the moving blade. This mixing thereby lowers the temperature of the downstream hot steam to a certain extent. As a result, differences in steam temperature between upstream and downstream positions in the passages can be reduced, and hence the cooling condition can be equalized over the entire moving blade.

The present invention provides a gas turbine cooled moving blade in which steam is led through the moving blade from one end of the moving blade root section, fed into the serpentine cooling passages installed over the range from the base to tip sections inside the moving blade, then discharged from the other end of said moving blade root section so as to collect the steam. A steam bypass is installed in at least one of the partition walls between adjacent cooling passages on said base section side. The following effects can be anticipated from the present invention:

(1) The adoption of steam cooling in a gas turbine can eliminate the use of cooling air, can downsize the physical dimensions of the compressor and cooler, and further can collect steam after cooling. The overall performance of the gas turbine can be improved.

(2) The installation of a bypass for steam can help equalize the steam temperature at each cooling passage, and can equalize the cooling condition over the entire moving blade from the trailing edge to the leading edge of the moving blade. Further, the installation of bypass holes in the moving blade fixes the core in the process of moving blade casting so that the core can be protected from being dislocated from its normal position.

DETAILED DESCRIPTION OF PREFERRED EMBODIMENTS

Figure 1:
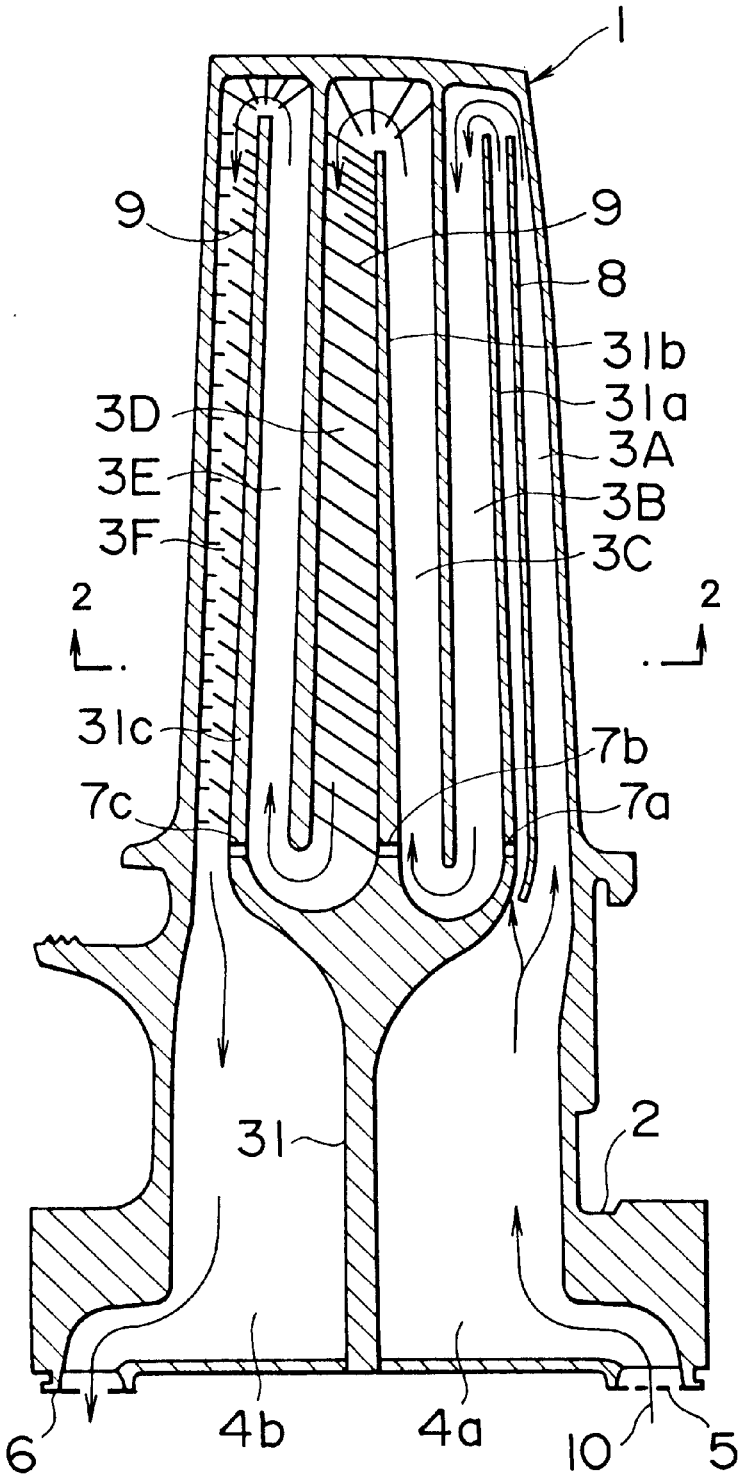
FIG. 1 is an inner cross-sectional view of a gas turbine cooled moving blade according to an embodiment of the present invention.
Figure 2:
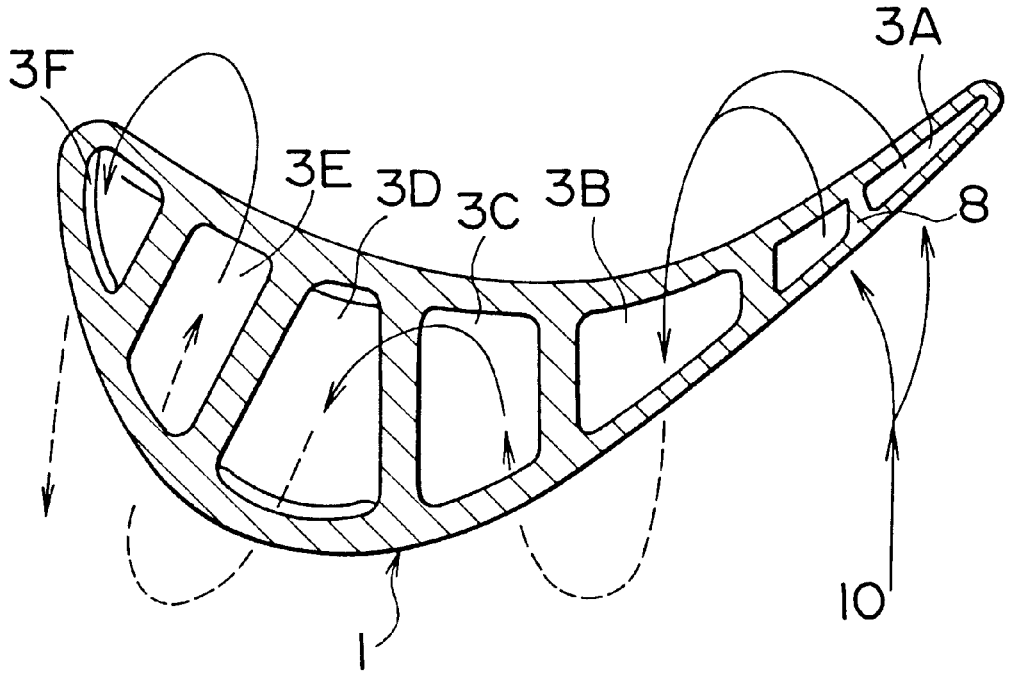
FIG. 2 is a cross-sectional view along line A—A of FIG. 1.
Figure 3:
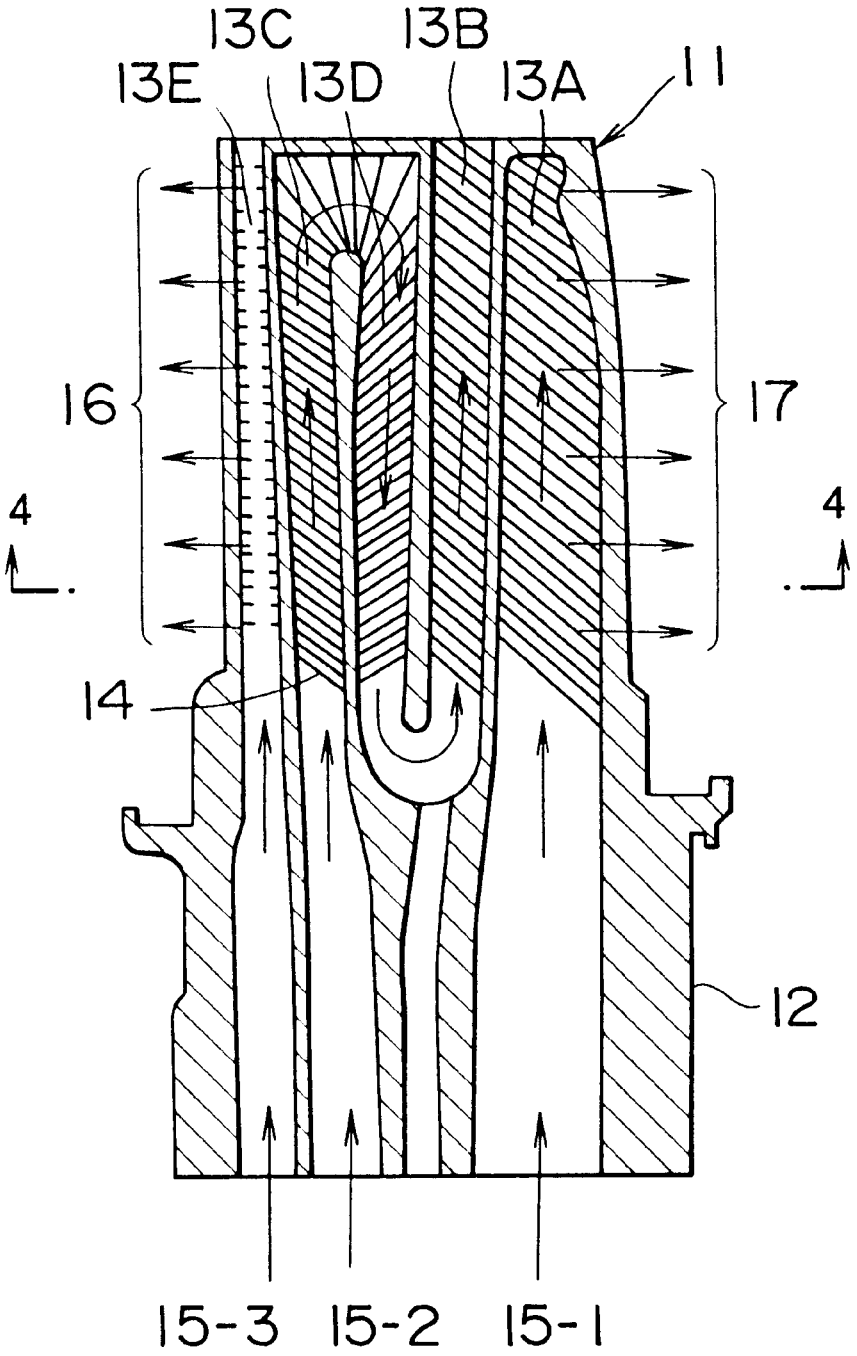
FIG. 3 (PRIOR ART)
FIG. 3 is an inner cross-sectional view of a conventional gas turbine cooled moving blade.

The following describes the embodiments of the present invention referring to attached drawings. FIG. 1 is an inner cross-sectional view of the gas turbine cooled moving blade according to an embodiment of the present invention, and FIG. 2 is a cross-sectional view taken along line A—A of FIG. 1.

In FIG. 1, reference numeral 1 indicates a general view of the moving blade, reference numeral 2 the moving blade root section thereof. Reference numerals 3A, 3B, 3C, 3D, 3E, and 3F indicate steam passages inside the moving blade, and the first steam passage 13A is in communication with the second steam passage 3B in the upper part of the moving blade. Further, the second steam passage 3B is in communication with the third steam passage 3C in the lower section of the moving blade, the third steam passage 3C is in communication with the fourth steam passage 3D in the upper part of the moving blade, and the fourth steam passage 3D is in communication with the fifth steam passage 3E in the lower part of the moving blade, and the fifth steam passage 3E is in communication with the sixth steam passage in the upper part of the moving blade. Accordingly, steam passages 3A through 3F together form serpentine cooling channels.

In the base section inside the moving blade, cavities 4*a* and 4*b* are installed, and these cavities 4*a* and 4*b* are separated from each other by a partition wall 31. The cavity 4*a* is in communication with a steam inlet 5 and the first steam passage 3A, the cavity 4*b* is in communication with the sixth steam passage 3F and the steam outlet 6.

Bypass 7*a* passes through the partition wall 31*a* between the first steam passage 3A and the second steam passage 3B, thereby enabling communication between the these first and second steam passages 3A and 3B. Likewise, bypass 7*b* is installed in the partition wall 31*b* between the third steam passage 3C and the fourth steam passage 3D, thereby enabling communication between these third and fourth steam passages 3C and 3D. Furthermore, bypass 7*c* is installed in the partition wall 31*c* between the fifth steam passage 3E and the sixth steam passage 3F, thereby enabling steam to bypass these fifth and sixth steam passages 3E and 3F.

These bypasses 7*a,* 7*b,* and 7*c* are positioned near or at the base of the moving blade. When steam on the upper side of each steam passage 3A through 3F flows upward, it cools the passage, absorbs heat from the passage, and returns to the next steam passage. The heated steam takes cool steam into it directly from the preceding steam passage through the bypasses 7*a,* 7*b.* With this, the steam temperature is equalized throughout, and more equal cooling becomes possible over the entire moving blade from the leading to trailing edges.

Further, another advantage of placing these bypasses 7*a,* 7*b,* and 7*c* in the partition wall is that they may be useful for a precision casting of the moving blade 1. That is, with the presence of these bypasses 7*a,* 7*b,* and 7*c,* the casting core may be fixed to prevent the dislocation of the core which might possibly be caused by heat during the casting process and cause errors in the positions of steam passages 3A through 3F and cavities 4*a* and 4*b,* and variations in casting thickness, etc. at the time of manufacture.

Additionally, although the embodiment shown in FIG. 1 is an example of a moving blade in which bypasses 7*a,* 7*b,* and 7*c* are installed in three different places, it is understood that these bypasses do not necessarily have to be installed in all the steam passages depending on which specifications are provided for the moving blade shape, the number of steam passages, the route of the steam passages, etc. the bypass may be installed in one, two, or more places in accordance with the specification of the passages, and cast condition, etc. as required.

Reinforcing rib 8, as shown in FIG. 2, is installed so as to divide the central section of the first steam passage 3A. This rib 8 reinforces a relatively longer and thin steam passage in the trailing edge to moderate the stress acting on the trailing edge. For example, in the case of a steam cooling type combined cycle system consisting of a combination of gas and steam turbines where steam from the steam turbine is partly extracted and led into the moving blades of the gas turbine, when steam with a pressure around 40 kg/cm$^2$ is led into the moving blade, the steam pressure in the combustion gas passage outside the moving blade is around 15 kg/cm$^2$.

Since this pressure difference causes the moving blade to be expanded and generates a stress in the particularly thin and long trailing edge, it is necessary to use the above mentioned reinforcing rib 8 to relieve the stress. Turbulators or linear projections 9 are installed on the steam passage walls in order to generate turbulence in the steam coming into the moving blade and to enhance heat transfer. The turbulators may be positioned obliquely to the direction of steam flow.

In the gas turbine cooled moving blade as described above, from the steam inlet 5 in the lower part of the moving blade root section 2, for example, steam 10 with a temperature around 375° C. is led into the moving blade, the steam 10 then fills the cavity 4*a,* and flows into the first steam passage 3A. In the first steam passage 3A, the steam passes through the two passages divided by the reinforcing rib 8, flows to the tip section while cooling these passages, and flows into the next steam passage 3B.

Part of the cold steam going into the first steam passage 3A from the above mentioned cavity 4*a* passes through the bypass 7*a* installed in the base section on the inlet side, goes directly into the next second steam passage 3B, is mixed together with the steam heated while passing the first and second passages and flowing from the tip section of said second steam passage 3B, and then the steam cooled by the bypassed steam flows into the next third steam passage 3C.

In the third steam passage 3C, the steam similarly flows into the tip section and partly goes into the fourth steam passage 3D via bypass 7*b,* and in the fourth steam passage 3D the hot steam which flowed from the tip section while absorbing heat and the cold steam via the bypass 7*b* are mixed together in the base section to cool the hot steam to some extent, and then as mixed steam flows into the fifth steam passage 3E.

In the fifth steam passage 3E, the steam which flowed into the fifth steam passage 3E from the base section similarly flows to the tip section and partly goes into the next sixth steam passage 3F via bypass 7*c,* where the steam via bypass 7*c* is mixed with the hot steam which was heated and flowed from tip section, where the hot steam is cooled to some extent, and then the steam flows out to cavity 4*b,* cools the cavity 4*b,* and is then discharged from steam outlet 6 where it is collected into the steam supply source.

Additionally, in the embodiment shown in FIG. 1, said turbulators 9 are installed along the sixth steam passage in the leading edge section having high thermal load and on the surface of the fourth steam passage 3D which is exposed directly to external high temperature combustion gas to accelerate turbulence and to enhance heat absorption.

As described so far, steam 10 with a temperature of around 375° C. is led into moving blade 1 from steam inlet 5, fed inside the moving blade and the cavities 4*a* and 4*b* through the steam passages 3A through 3F and bypasses 7*a,* 7*b,* and 7*c* to absorb heat from the moving blade 1 heated to about 1000° C. by external high temperature combustion gas to evenly cool the hot steam to less than 375° C. The cooled steam is then discharged and collected in the steam supply source. With this process, the moving blades are cooled by steam without using air, and the used steam 10 is collected, thereby allowing downsizing of the compressor and cooler and the enhancement of the performance of the gas turbine.

Further, because the holes of bypasses 7*a,* 7*b,* and 7*c* protect the core from being dislocated when casting the moving blade, the moving blade can be manufactured with higher precision, and the steam temperature in each steam passage inside the moving blade can be equalized by these bypasses over the range from the leading edge side to the trailing edge side, thereby allowing the even cooling of the entire moving blade.

Furthermore, since cooling steam 10 from the steam inlet is supplied into the moving blade and collected from the steam outlet 6, the steam 10 is heated to high temperature and returned to the steam supply source, and then effectively recycled. The steam cooling system according to the present invention is advantageous for performance when compared with the conventional air cooling system in which air after cooling the gas turbine is discharged to the combustion gas passage.

We claim:

1. A gas turbine cooled moving blade which comprises:

a blade body;

a root section divided into two sections;

a serpentine cooling passage disposed inside the blade body and arranged to receive steam from one section of the root section so that steam flows through the serpentine cooling passage from a base section to a tip section of the blade body, and the serpentine cooling passage arranged to discharge steam into the other section of said root section so that steam is collected therefrom, the serpentine cooling passage including at least a first portion arranged to carry steam from the base section toward the tip section and a second portion sequentially connected to the first portion and arranged to carry steam from the tip section back to the base section, the serpentine cooling passage further including a partition wall separating said first portion of the cooling passage from said second portion thereof; and a bypass for steam disposed in the partition wall near said base section, the bypass diverting a part of the steam entering said first portion of the cooling passage into the second cooling passage near said base section so as to mix with relatively higher-temperature steam that has flowed through the second portion of the cooling passage.

2. The gas turbine cooled moving blade as claimed in claim 1, wherein the cooling passage on a trailing edge side of the moving blade is equipped with a reinforcing rib for dividing the cooling passage into two or more passages.

* * * * *

UNITED STATES PATENT AND TRADEMARK OFFICE
CERTIFICATE OF CORRECTION

PATENT NO. : 6,036,440

DATED : March 14, 2000

INVENTOR(S) : Tomita et al.

It is certified that error appears in the above-identified patent and that said Letters Patent is hereby corrected as shown below:

Title page, [56] References Cited, insert the following:

--FOREIGN PATENT DOCUMENTS

| | | |
|---|---|---|
| 2823496 | 12/1978 | Germany |
| 0340149 | 11/1989 | European Patent Office--. |

Figure 4:
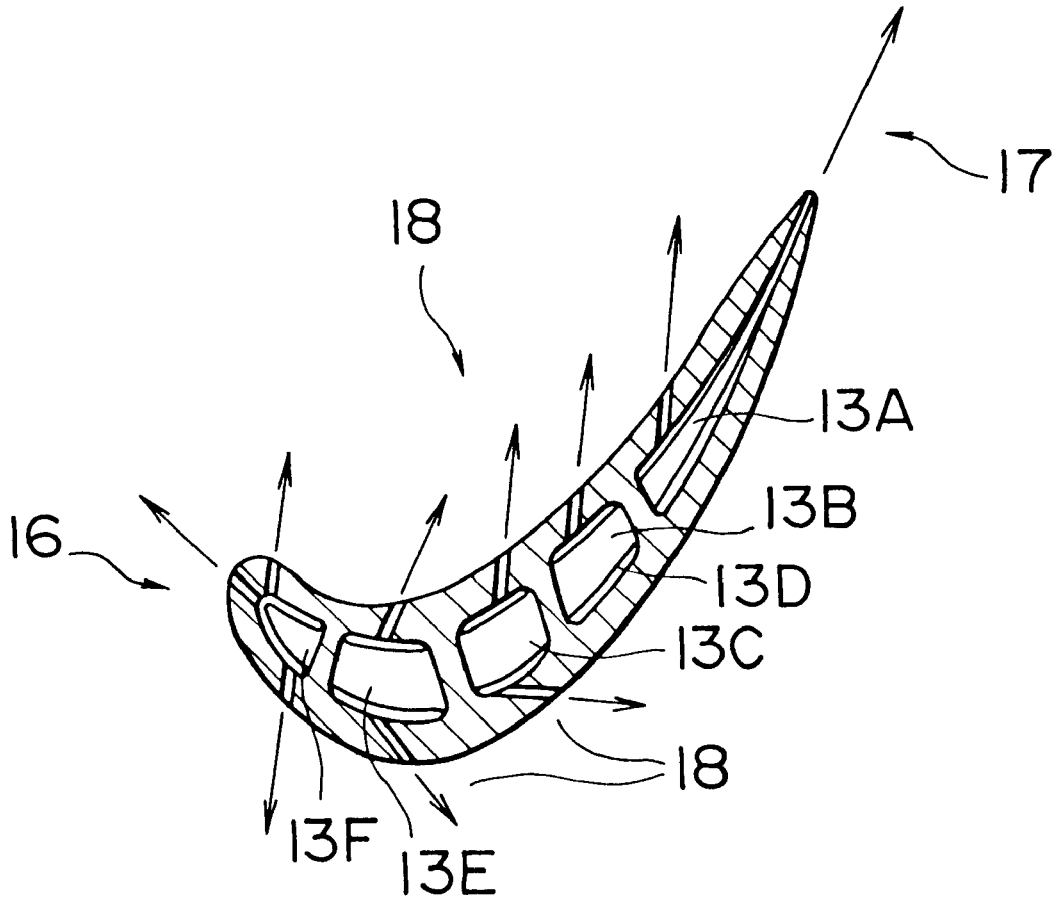
FIG. 4 (PRIOR ART)
FIG. 4 is a cross-sectional view along line B—B of FIG. 3.
Figure 5A:
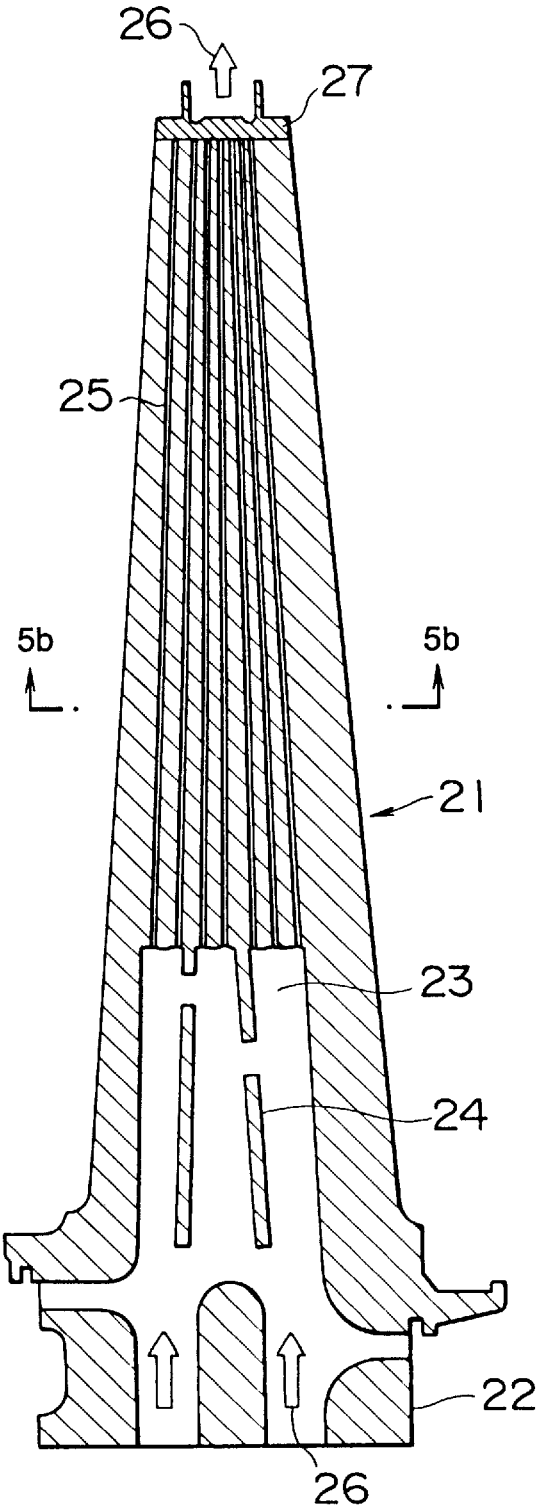
FIG. 5a (PRIOR ART)
FIGS. 5(*a*) and 5(*b*) show a cooled moving blade used by another method of conventional gas turbine, of which FIG. 5(*a*) is an inner cross-sectional view of the cooled moving blade, and FIG. 5(*b*) a cross-sectional view along line C—C of FIG. 5(*a*).
Figure 5B:
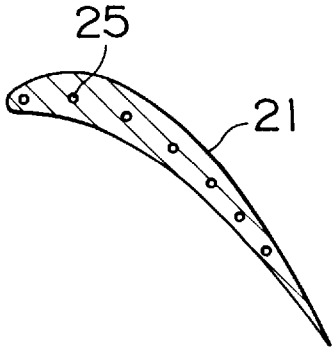
FIG. 5b (PRIOR ART)
Figure 4:
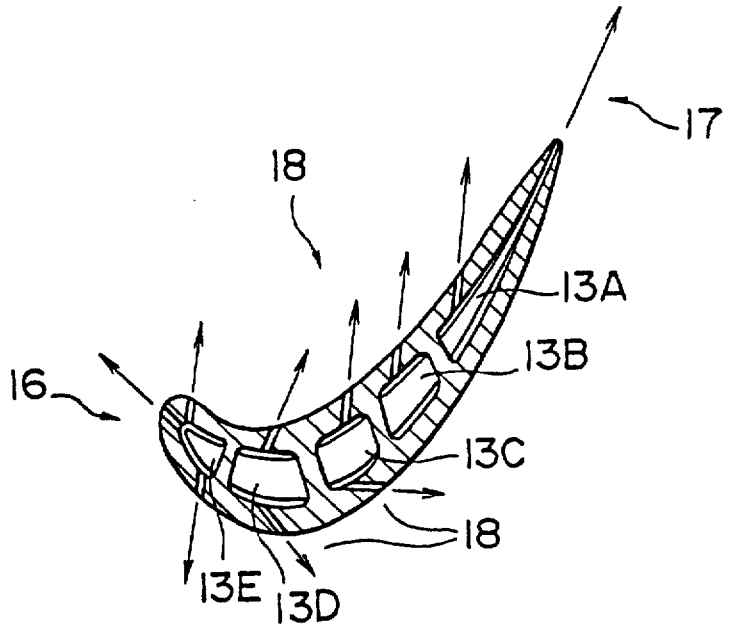
FIG. 4 (PRIOR ART)

In the drawings, Fig. 4 should be deleted to be substituted with the attached Fig. 4, as shown on the attached pages.

Column 3, line 63, "13A" should read --3A--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*